US005418996A

United States Patent [19]

Chen

[11] Patent Number: 5,418,996

[45] Date of Patent: May 30, 1995

[54] SHOE WASHING MACHINE

[75] Inventor: Hung-Jen Chen, Chia-Yih Hsien, Taiwan, Prov. of China

[73] Assignee: Glomax Waste Energy Plant, Chia-Yih City, Taiwan, Prov. of China

[21] Appl. No.: 165,455

[22] Filed: Dec. 13, 1993

[51] Int. Cl.[6] ..... A47L 23/00

[52] U.S. Cl. ..... 15/36; 15/97.2

[58] Field of Search ..... 15/36, 21.1, 56, 71, 15/75, 76, 88.1

[56] References Cited

U.S. PATENT DOCUMENTS

| | | | |
|---|---|---|---|
| 357,049 | 2/1887 | Talley et al. | 15/71 |
| 1,307,670 | 6/1919 | Hostad | 15/36 |
| 1,569,167 | 1/1926 | Anderson, Sr. | 15/36 |
| 1,596,676 | 8/1926 | Manger | 15/36 |

FOREIGN PATENT DOCUMENTS

| | | | |
|---|---|---|---|
| 1218501 | 12/1959 | France | 15/56 |
| 1009848 | 6/1957 | Germany | 15/56 |
| 2645093 | 4/1978 | Germany | 15/36 |
| 2811094 | 9/1979 | Germany | 15/36 |
| 1447432 | 12/1988 | U.S.S.R. | 15/56 |
| 1518285 | 10/1989 | U.S.S.R. | 15/56 |
| 8803775 | 6/1978 | WIPO | 15/36 |

*Primary Examiner*—David A. Scherbel
*Assistant Examiner*—Tony G. SooHoo
*Attorney, Agent, or Firm*—Morton J. Rosenberg; David I. Klein

[57] ABSTRACT

A shoe washing machine includes a case, a driving means, and a washing means. The case has a cover hingeably connected to the end on the top thereof, a sink being formed at inner portion having an opening at bottom portion adopted to drain water through the opening and out of the case, two water tanks at inner portion having connected with the inner wall in an inclining manner and a plurality of holes all over the tanks' wall. The driving means includes a driving motor adopted to drive a pair of driven motors to rotate. The driven motors drive a pair of discs to rotate, simultaneously. The washing means includes a pump at inner bottom portion of the case, one conduit extending from the pump to the bottom portion of the cover, and two manifolds extending from the conduits into the respective water tanks, each manifold having a plurality of apertures to sparkle water and a brush at the bottom portions to brush the shoes.

4 Claims, 4 Drawing Sheets

SHOE WASHING MACHINE

BACKGROUND OF THE INVENTION

1. Field of the Invention

This invention relates to a shoe washing machine, and more particularly to a shoe washing machine adapted to wash both the inside and outside of shoes in a thorough and completely automatic manner.

2. Prior Art

Prior art shoe washing machines generally wash the outside or external surfaces of shoes to be cleaned. In such prior art machines the inside of the shoe due to unique design and contouring has to be cleaned by a separate cleaner inserted into the shoes to clean the interior. Such prior art shoe washing machines require the user to spend additional time in cleaning the interior of the shoes and thus are not economically efficient.

Such prior art shoe machines do not provide a shoe washing machine which can clean both the inside and outside of the shoes in one working operation.

SUMMARY OF THE INVENTION

It is the primary object of the present invention to provide a shoe washing machine which includes a pair of brushes which can clean both the inside and outside of the shoes.

It is another object of the present invention to provide a shoe washing machine which includes a cover on top of the shoe washing machine that will seal the interior for preventing water from splashing or spilling out of the interior and thus conforms to environmental control standards.

It is a further object of the present invention to provide a shoe washing machine which is fully automatic and is simple to operate.

DETAILED DESCRIPTION OF THE PREFERRED EMBODIMENT

Figure 1:
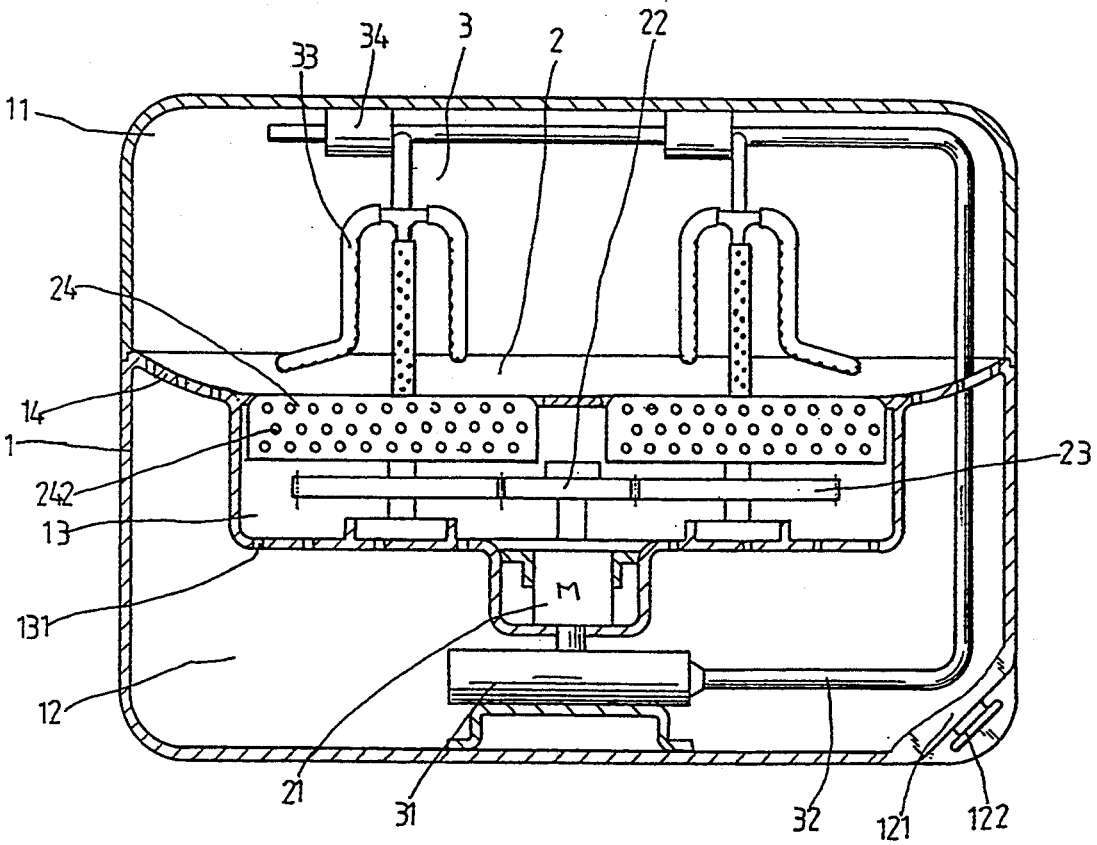
FIG. 1 is a cross-sectional elevational view of the present invention.

Referring now to FIG. 1, there is shown a shoe washing machine of the present invention which includes a case 1, having a drive mechanism 2 and a washing mechanism 3 encased therein.

The case 1 is generally contoured in the form of a sink having a cover 11 hingeably coupled to a top section of case i on one side thereof to allow opening and closure of the case 1 in the usual manner. A sink 12 is provided at the bottom portion of the case 1 and has an opening 121 formed through the bottom portion which is closed by a cap plug 122 and allows water to drain therethrough. Two water tanks 13 are suspended in the case 1 by an inclined rib wall 14 extending from a peripheral wall of the water tanks to the wall of the case 1. The water tanks 13 have a plurality of apertures 131 formed through the walls adapted to drain water from the tanks 13 into the sink 12.

Figure 2:
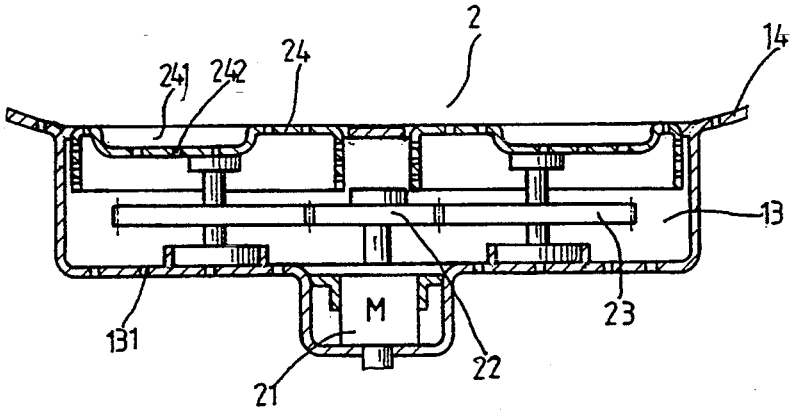
FIG. 2 is a cross-sectional elevational view of a driving means of FIG. 1.
Figure 4:
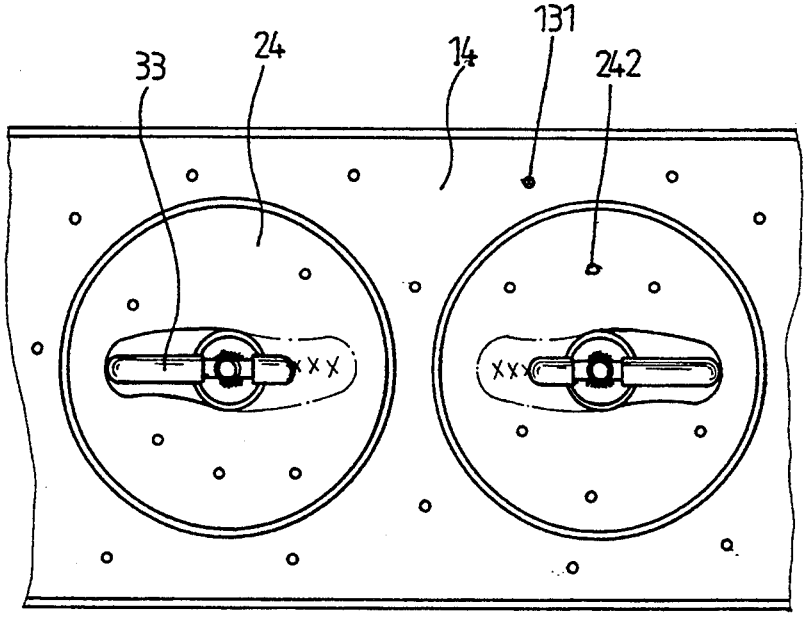
FIG. 4 is a plan view of FIG. 3.

The drive mechanism 2 includes a driving motor 21 which provides the primary power to rotatively drive a pair of driven gears 23, meshingly engaged to a motor gear 22. The driven gears 23 then drive a pair of discs 24 which rotate simultaneously, as shown in FIG. 2. In this manner, motor 21 rotatively actuates motor gear 22 which rotatively drives driven gears 23 to responsively rotatively drive discs 24. Each of the discs 24 is formed with a recess or dented portion 241 in a top portion thereof, as shown in FIGS. 2 and 4, which is shaped to receive a shoe therein. A plurality of apertures 242 are formed through the wall for draining water from the tank 13 into the sink 12.

Figure 3:
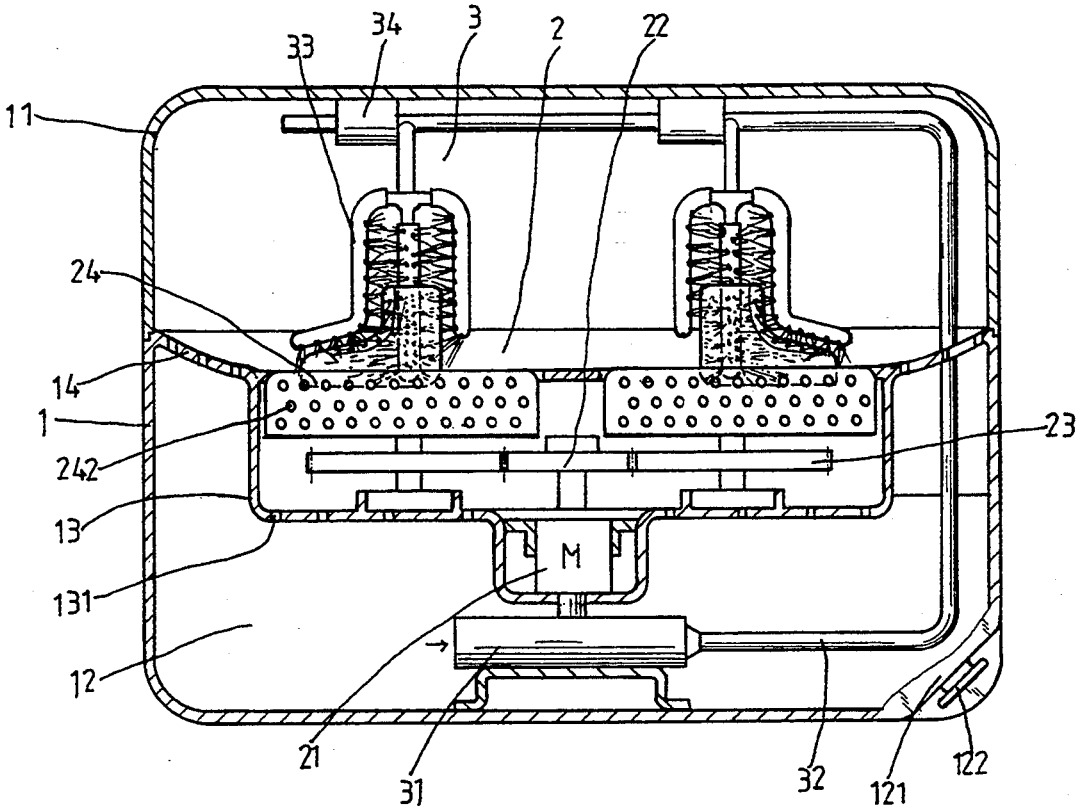
FIG. 3 is a cross-sectional elevational view of FIG. 1 with the brushes in place.
Figure 5:
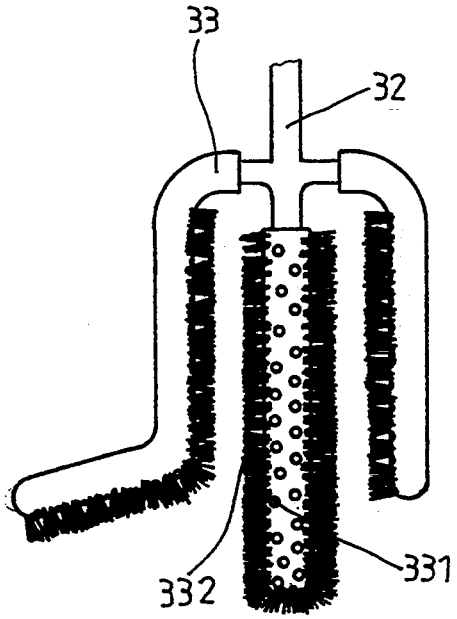
FIG. 5 is an enlarged elevational view showing the relationship between the brushes and water sprinkle apertures.

The washing mechanism 3 includes a pump 31 secured within the inner bottom portion of the case 1 and has a conduit 32 extending therefrom to the inner upper portion of the cover 11 and is secured by fixtures 34. A pair of manifolds 33 shown in FIG. 5 have apertures 31 formed therethrough and brushes 332 mounted thereon which extend downwardly from the conduit 32. Each manifold 33 has at least three pipes, as shown in FIG. 5, with one pipe bending outwardly adapted to brush the shoe surface with the remaining pipes extending linearly to brush the inside and the heel of the shoes. The extending pipes, the apertures 31, and the brushes 332 of the manifolds 33 are shaped and positioned to contiguously interface with and clean the shoes which are positioned in the dented or recess portions 241 of the discs 24 for the inner shoe surfaces and the outer shoe surfaces, as shown in FIG. 3.

In operation, when the cover 11 is closed, the brushes 332 will contiguously interface with the inner and the outer surfaces or portions of the shoes which are seated in the dented or recess portions 241 of the discs 24. Water will be provided by the pump 31 through the conduit 32 and sprinkled through the apertures 331 of the sprinklers 33. The discs 24 will be driven to rotate by the driving motor 21 through the driven motor gear 22, and the driven gears 23. The shoes are located in the recesses 241 and rotate with the discs 24 which rotate relative to the brushes 332. This rotation allows the brushes 332 to brush the shoes from both the inner and the outer surfaces. The water accumulated in the discs 24 will be drained into the water tanks 13 through the apertures 242 and then drained into the sink 12 through the apertures 131. In addition to the brushes 332, the apertures 331 also provide a cleaning effect since water is ejected therefrom.

I claim:

1. A shoe washing system comprising:

(a) a case having a cover hingedly coupled to one side of said case at a top portion thereof, said case having a bottom portion forming a sink and having an opening formed through said bottom portion for draining water from said case;

(b) a pair of water tanks fixedly positioned within said case and coupled to a wall of said case by a rib wall, each of said water tanks having apertures formed therethrough for draining water from said water tanks;

(c) driving means positioned within said case including a drive motor for rotatively displacing a motor gear, said motor gear meshingly coupled to a pair of driven gears;

(d) a pair of disc members respectively positioned within each of said water tanks and coupled to each of said driven gears for rotation of said disc members responsive to a rotation of said driven gears, each of said disc members having a contoured recessed section for insert of a respective shoe; and, (e) wash means for washing said shoes mounted within said recesses of said disc members, said wash means including a pump located within said bottom portion of said case, a wash conduit fluidly coupled to said pump and extending to said cover and fixedly secured thereto, and a pair of manifolds in fluid communication with said wash conduit and coupled thereto, each of said manifolds extending downwardly from said conduit and having apertures formed therethrough and brushes mounted thereon for contiguous interface with surfaces of said shoes.

2. The shoe washing system as recited in claim 1 where each of said manifolds includes at least three pipe members, a first of said pipe members being arcuately formed for interface with a frontal exterior surface of a respective shoe, a second of said pipe members being linearly directed for interface with a rear exterior surface of said respective shoe, and a third of said pipe members being linearly directed for insert into an interior of said respective shoe.

3. The shoe washing system as recited in claim 1 including a cap plug releasably insertable within said case bottom portion opening to seal and maintain water within said casing when said cap plug is inserted within said opening and to permit draining of water from said casing when said cap plug is removed from said opening.

4. The shoe washing system as recited in claim 1 where said rib wall extends in an inclined manner from said case wall to said water tanks for draining water into said water tanks.

* * * * *